US010327546B2

(12) United States Patent
Kimball

(10) Patent No.: US 10,327,546 B2
(45) Date of Patent: Jun. 25, 2019

(54) ROTATABLE AND CONFIGURABLE STORAGE TREE

(71) Applicant: Penny Kimball, Richland, NY (US)

(72) Inventor: Penny Kimball, Richland, NY (US)

( * ) Notice: Subject to any disclaimer, the term of this patent is extended or adjusted under 35 U.S.C. 154(b) by 59 days.

(21) Appl. No.: 15/622,922

(22) Filed: Jun. 14, 2017

(65) Prior Publication Data

US 2017/0360194 A1 Dec. 21, 2017

Related U.S. Application Data

(60) Provisional application No. 62/351,330, filed on Jun. 17, 2016.

(51) Int. Cl.
*A47F 5/02* (2006.01)
*A47B 49/00* (2006.01)
*A47B 97/04* (2006.01)

(52) U.S. Cl.
CPC ..... *A47B 49/008* (2013.01); *A47B 97/04* (2013.01); *A47F 5/02* (2013.01); *A47B 2220/0097* (2013.01)

(58) Field of Classification Search
CPC ..... A47F 5/02; A47F 5/04; A47F 5/05; A47F 7/02
USPC ..... 160/135; 52/239; 211/163, 169, 40
See application file for complete search history.

(56) References Cited

U.S. PATENT DOCUMENTS 2,950,155 A * 8/1960 Schick ..... A47F 5/02 211/163
3,092,258 A * 6/1963 Bleed ..... A47F 5/02 211/163
3,195,736 A * 7/1965 Bomar, Jr. ..... A47F 5/05 211/163
3,255,890 A * 6/1966 Gerber ..... A47F 5/02 211/1.54
3,337,059 A * 8/1967 Le Hoy ..... A47F 5/05 211/107
3,513,606 A * 5/1970 Jones ..... A47B 47/0016 211/182
3,538,863 A * 11/1970 Howard ..... A47F 3/10 108/105
3,565,152 A * 2/1971 Cohn, Jr. ..... A47G 5/00 160/135
3,641,950 A * 2/1972 Axhamre ..... A47F 5/02 108/109
3,685,664 A * 8/1972 Kramer ..... A47F 5/02 108/106
3,756,422 A * 9/1973 Ostring ..... A47F 5/02 211/163
3,865,249 A * 2/1975 Herzog ..... A47F 5/02 211/163
3,917,072 A * 11/1975 Bleed ..... A47F 5/02 211/167
3,924,749 A * 12/1975 Weston ..... A47F 5/04 211/169
4,102,069 A * 7/1978 Eckert ..... A47F 5/02 211/169
4,241,964 A * 12/1980 Grubb, Jr. ..... A47B 63/062 108/139

(Continued)

*Primary Examiner* — Kimberley S Wright
(74) *Attorney, Agent, or Firm* — The Iwashko Law Firm PLLC

(57) ABSTRACT

A storage tree, including a rotatable base, a center post attached to a center portion of the base, a plurality of outer posts attached to the base at outer portions of the base, and a plurality of panels disposed between each of the plurality of outer posts and the center post.

5 Claims, 5 Drawing Sheets

(56) References Cited

U.S. PATENT DOCUMENTS 4,270,290 A * 6/1981 Eckert ..... A47F 5/02 211/169
5,660,637 A * 8/1997 Dodge ..... B05B 13/0285 118/500
5,689,926 A * 11/1997 Nichols ..... E04B 2/7442 52/239
6,116,326 A * 9/2000 Domina ..... A47G 5/00 160/351
6,182,740 B1 * 2/2001 Pfaff ..... A47G 5/00 160/135
D479,059 S * 9/2003 Lucht ..... D6/680.2
6,701,996 B1 * 3/2004 Chen ..... A47G 5/00 160/135
6,896,028 B2 * 5/2005 Brennan ..... A47B 97/00 160/351
6,942,112 B2 * 9/2005 Robbins, III ..... A47F 5/02 211/113
D543,760 S * 6/2007 Utzinger, III ..... D6/553
D595,918 S * 7/2009 Walter ..... D34/27
7,810,658 B2 * 10/2010 Clark ..... A47F 5/137 211/189
7,827,920 B2 * 11/2010 Beck ..... A47B 83/001 108/50.01
8,342,343 B2 * 1/2013 Shea ..... A47F 5/0018 211/163
8,807,356 B2 * 8/2014 Weigand ..... A47F 5/10 211/183
8,959,813 B2 * 2/2015 Denby ..... A47F 5/10 211/175
9,609,961 B2 * 4/2017 Lindblom ..... A47F 5/101
2005/0109720 A1 * 5/2005 Marchetta ..... A47B 47/022 211/87.01
2005/0173362 A1 * 8/2005 Squitieri ..... A47F 5/10 211/187
2005/0284825 A1 * 12/2005 Goldsmith ..... A47F 3/002 211/4

* cited by examiner

ROTATABLE AND CONFIGURABLE STORAGE TREE

CROSS-REFERENCE TO RELATED APPLICATIONS

This application claims priority under 35 USC § 120 from U.S. Provisional Application No. 62/351330, filed on Jun. 17, 2016, in the United Stated Patent and Trademark Office, the disclosure of which is incorporated herein in its entirety by reference.

BACKGROUND OF THE INVENTION

1. Field of the Invention

The present general inventive concept relates to a rotatable and portable storage tree (e.g., craft tree) having a plurality of panels for storage.

2. Description of the Related Art

Artists (e.g., painters, sculptors, stained glass workers, sketchers, etc.), craftsmen (e.g., crafters, woodworkers, carvers, etc.), mechanics, seamstresses, engineers, and chefs all share a commonality of requiring various tools and/or utensils to properly and successfully perform their work. For example, in order for a painter to paint a portrait, the painter may require materials such as paper, pencils, erasers, paint, brushes, a stapler, a camera, gloves, charcoal, glitter, etc. However, the aforementioned materials are typically not stored in a single location. More specifically, most people would store paper in a cabinet, erasers in a desk drawer, pencils in a pencil holder on a desktop, paint on a shelf, brushes in a brush-case, a stapler on a desktop, a camera in a closet, gloves in a dresser-drawer, charcoal in a box, and glitter in a jar. Therefore, when the painter desires to paint the portrait, he/she is required to collect the aforementioned materials from each of the different locations, and place the materials on a table, for example. This results in inconvenience and an inefficient use of time for the painter, as the painter must first go to each location to collect the required materials, and then organize the materials on the table for use. Moreover, this waste of time may cause added stress, fatigue, and frustration for the painter, thereby distracting and clouding the painter's mind, and accordingly, affecting his/her capacity for artistic creativity. Therefore, it would be convenient for the painter to have an art-supply storage system that allows for convenient storage and easy access of all art-supplies needed to produce a work of art. Also, it would be convenient if the art-supply storage system included an organizational system that allowed the painter to quickly locate a tool, utensil, material, etc., which is needed to perform a particular task at a particular moment.

Similarly, a mechanic working on a car engine may require various tools to fix the engine, including, for example, a screwdriver, a wrench, nuts/bolts, a power drill, motor oil, a saw, etc. The aforementioned tools may be stored in various places, such as toolboxes, shelves, drawers, etc., thereby again, making it inconvenient and inefficient for the mechanic to properly and quickly fix the car engine. Also, tools such as the power drill may be too large to fit inside a drawer or toolbox, and accordingly must be stored elsewhere, such as a wall-hook, peg-board, or shelf. Although the peg-board solution, for example, allows the mechanic to easily find the tools hung thereon, the peg-board is an unaesthetic and inefficient use of wall-space. Moreover, tools placed within a toolbox are typically mixed up inside the box, making it difficult for the mechanic to locate a particular tool, and can even get damaged as a result of being mixed together. Therefore, it would be convenient for the mechanic to have a tool storage system that allows for convenient storage of all tools needed to perform mechanic-related tasks. Also, it would be convenient if the tool storage system included an organizational system that allowed the mechanic to quickly locate a tool that is needed to perform a particular task at a particular moment.

Since the time when human beings first developed tools, a convenient way to organize and store the tools needed to perform a specific task has been a necessity. Prior art methods of organizing and storing tools are numerous including bags, belts, pails, etc. Some tool users keep their tools in boxes. Early tool boxes were made of wood. While these wooden tool boxes enabled tools to be kept in a single location and protected, wooden tool boxes did not present a convenient way to organize tools so that the tool required at a particular time could be easily identified and located. Many tools were simply dumped into a box and the person needing a specific tool had to rummage through all of the tools in the box or selectively remove tools one by one until the right tool was found for the job at hand.

The development of sophisticated manufacturing techniques has enabled low cost tools of all shapes and sizes to be made available to users. However, with more tools available to users the problem of storing and organizing all of the tools in a user's possession is exacerbated.

To this day, many conventional tool boxes simply include a removable tray sized to fit into the top of a tool box. By using the removable tray, smaller hand tools such as wrenches and screwdrivers can be separated from larger, less frequently used tools such as hammers and pipe wrenches. These larger tools are typically stored in the bottom of the tool box. For the sophisticated builder, car mechanic or repairman, a tool box with a simple tray insert is insufficient to organize all the different types of tools that might be necessary to complete a job. Moreover, a mechanic with a large collection of different tools will have a difficult time finding the right tool for the job in a tool box having only a top tray, thereby wasting valuable time and energy.

To organize and hold the many tools used by a mechanic, builder or repairman, chest-type metal tool boxes were developed. These prior art chest-type tool boxes can be from three feet to six feet in height. In each chest-type tool box are a number of different sized drawers into which even the heaviest tools can be placed for storage and protection. Some of these prior art tool boxes are made to be movable by the use of casters. However, large prior art chest-type tool boxes are too big to fit into tight spaces and cannot be rolled into spaces with a low overhead such as underneath a car or a truck. Moreover, the tools in chest-type tool boxes are stored inside the drawers, out of sight from the mechanic. Unless the mechanic has memorized the drawer location for each tool, the mechanic must open each drawer and then examine the contents of each drawer to find the right tool. This effort to find the right tool for a job requires the mechanic to leave a job in progress, walk over to the tool box and locate the right tool.

What is needed in the art is a tool organizing system which can be moved alongside a workman to the job site that will provide easy access to a large selection of tools. In addition, the tool organizing system should be able to fit in tight spaces as well as spaces with a low overhead and still present needed tools to the mechanic so that the mechanic does not have to dig through an unorganized pile of tools to find the right tool for the task at hand.

Furthermore, for a user with mobility problems and who can't keep getting up and down, it would be convenient to have all tools, utensils, items, and materials disposed in one storage area to limit the amount of times the user needs to get up and/or move to different locations to obtain the necessary tools, utensils, items, and materials.

Therefore, it would be desirable to have a compact, portable, changeable, and aesthetically-pleasing organizing system that allows a user to conveniently store, categorize, locate, and access tools, utensils, items, equipment, and materials based on the user's preference.

SUMMARY

The present general inventive concept provides a rotatable and portable storage tree (e.g., craft tree) having a plurality of panels for storage.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a storage tree, including a rotatable base, a center post attached to a center portion of the base, a plurality of outer posts attached to the base at outer portions of the base, and a plurality of panels disposed between each of the plurality of outer posts and the center post.

The storage tree may further include an upper lateral bar disposed between the center post and one of the plurality of outer posts such that the center post is connected to the one of the plurality or outer posts at upper portions thereof.

The storage tree may further include an lower lateral bar disposed between the center post and the one of the plurality of outer posts such that the center post is connected to the one of the plurality or outer posts at lower portions thereof, and a fabric panel draped over the upper lateral bar and wrapped around a lower lateral bar, such that the fabric is connected at a lower portion of the fabric panel.

The fabric panel may be connected at the lower portion of the fabric panel using at least one of snaps, pins, VELCRO, buttons, zippers, and thread.

The center post may include at least one panel receiving groove and at least one of the plurality of outer posts comprises at least one panel receiving groove facing the at least one panel receiving groove of the center post.

The at least one of the plurality of panels may be disposed within the at least one panel receiving groove of the center post and at least one panel receiving groove of the at least one of the plurality of outer posts.

The at least one of the plurality of panels may a fabric panel and at least another one of the plurality of panels may be a peg board comprising holes.

The rotatable base may include a plurality of wheels to allow the storage tree to move laterally, a base bottom attached to the plurality of wheels, a turntable rotatably connected to the base bottom, and a base top fixed to the turntable to allow the storage tree to rotate without movement from the plurality of wheels.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like or similar elements throughout the description of the figures.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
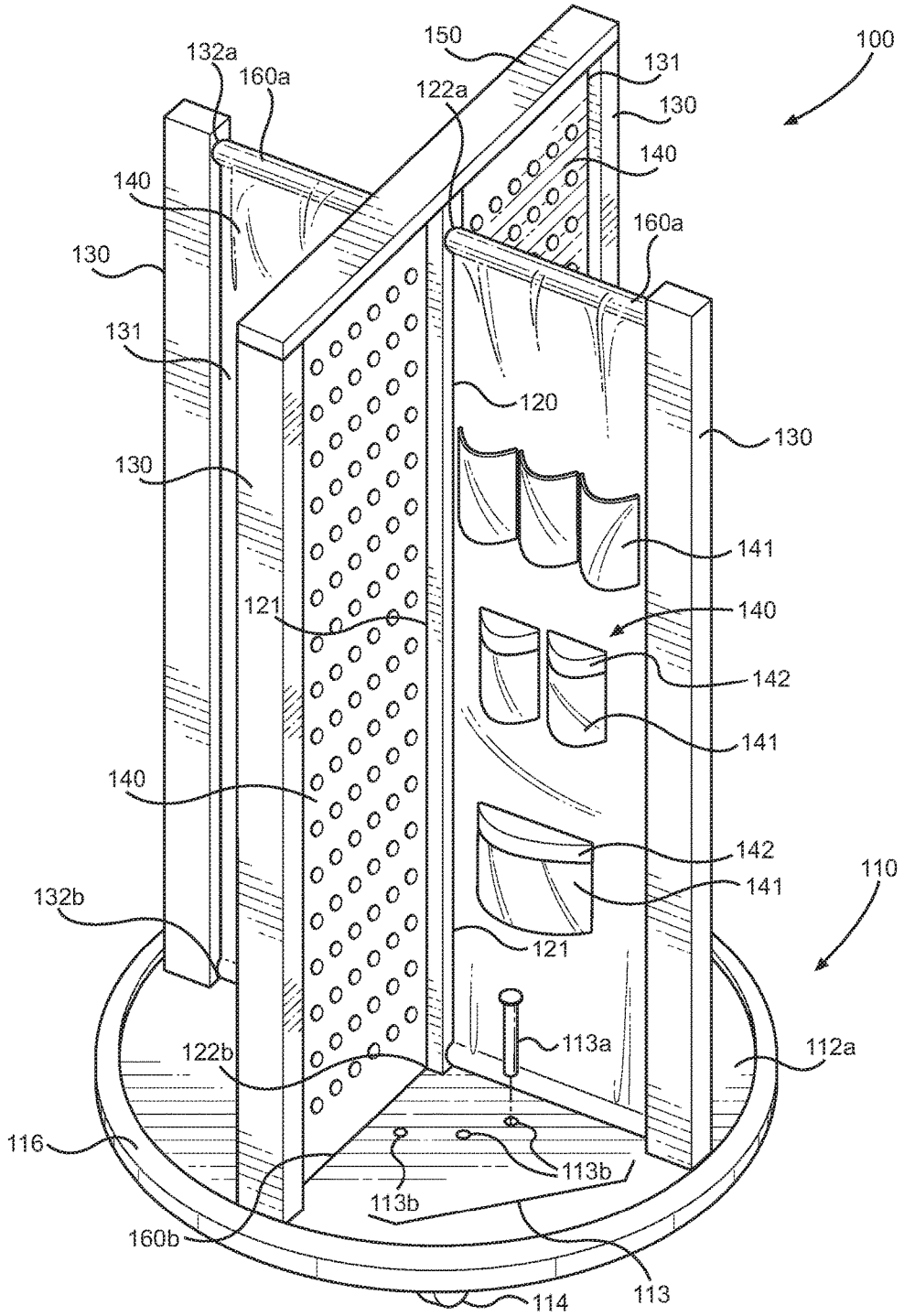
FIG. 1 is an angled view schematically illustrating a storage tree, according to an exemplary embodiment of the present general inventive concept.

FIG. 1 is an angled view schematically illustrating a storage tree 100, according to an exemplary embodiment of the present general inventive concept.

Figure 2B:
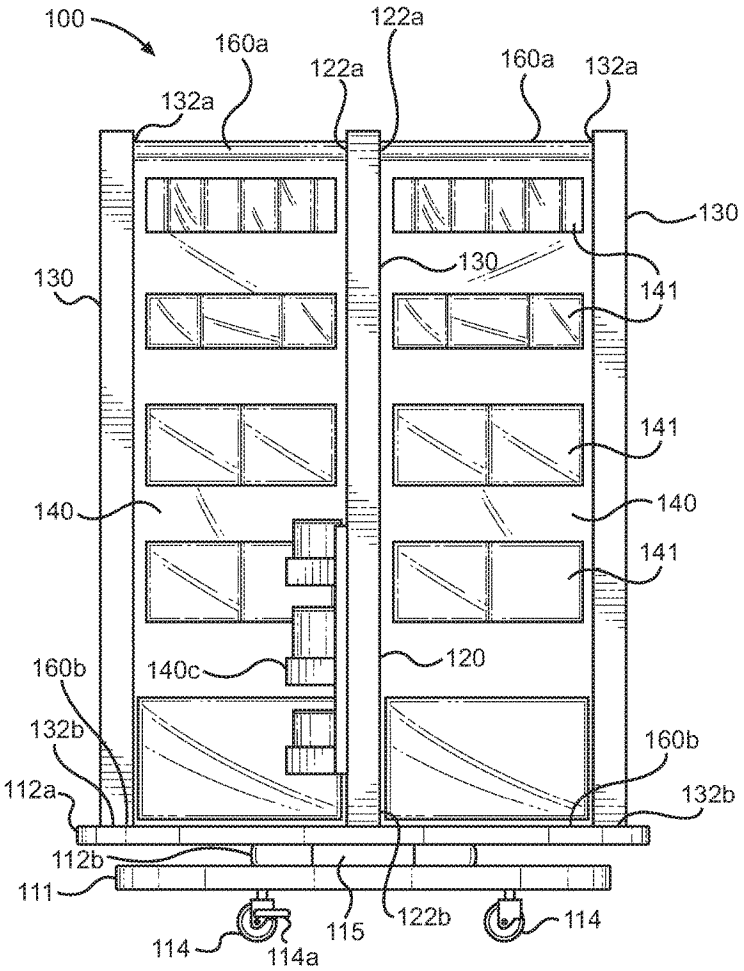
FIG. 2B is another side view schematically illustrating the storage tree of FIG. 2A rotated clockwise by ninety degrees, according to an exemplary embodiment of the present general inventive concept.
Figure 2A:
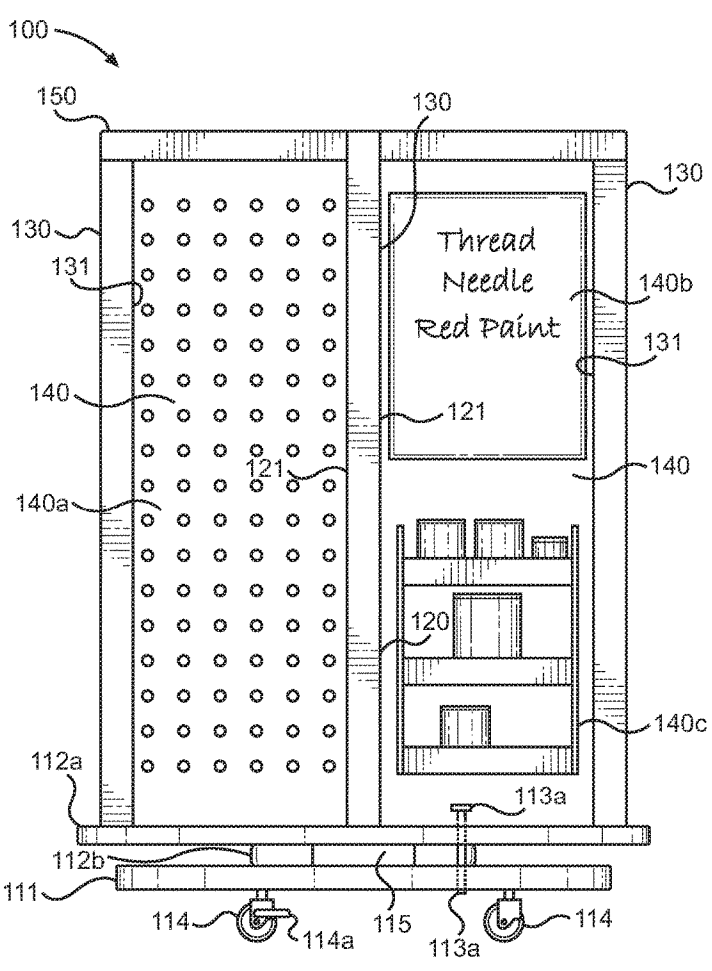
FIG. 2A is a side view schematically illustrating the storage tree of FIG. 1, according to an exemplary embodiment of the present general inventive concept.

FIG. 2A is a side view schematically illustrating the storage tree 100 of FIG. 1, according to an exemplary embodiment of the present general inventive concept.

FIGS. 2B is another side view schematically illustrating the storage tree 100 of FIG. 2A rotated clockwise by ninety degrees, according to an exemplary embodiment of the present general inventive concept.

Referring to FIGS. 1, 2A, and 2B, the storage tree 100 may include a base 110, a center post 120, a plurality of outer posts 130, and at least one panel 140.

Figure 3B:
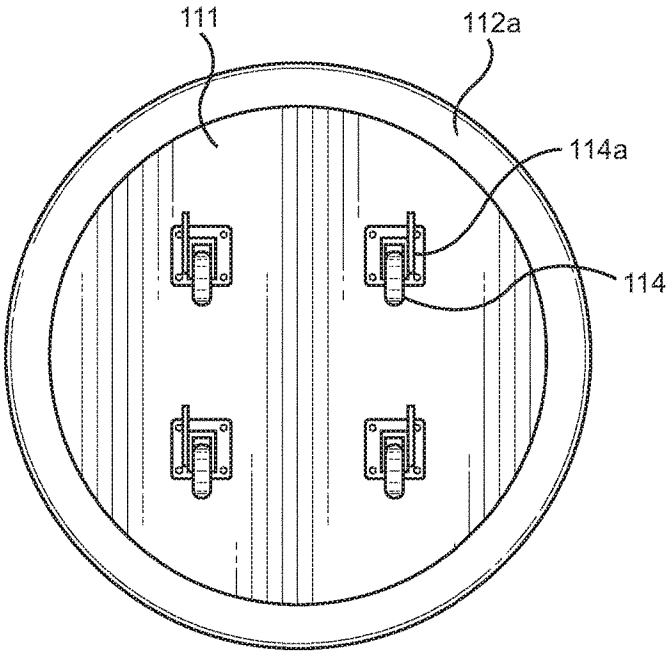
FIG. 3B is a bottom view schematically illustrating the storage tree, according to an exemplary embodiment of the present general inventive concept.
Figure 3A:
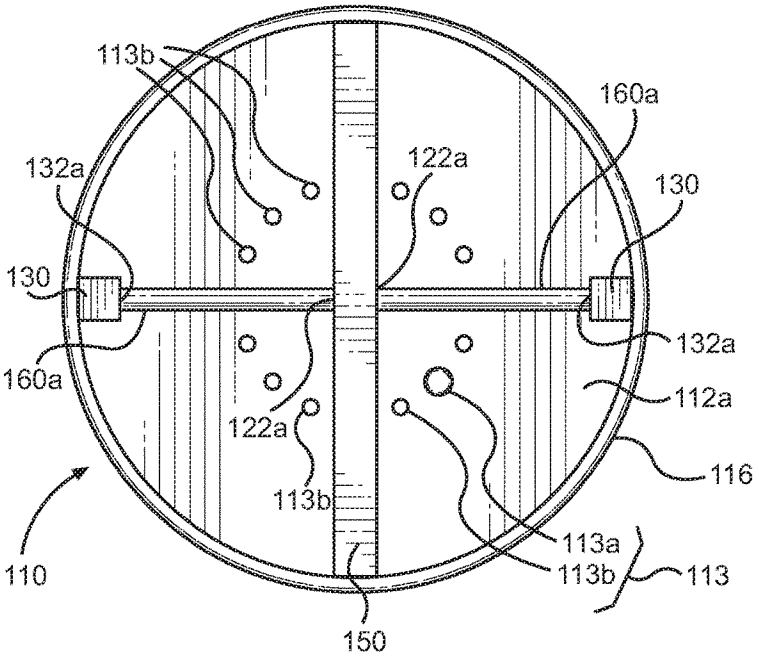
FIG. 3A is a top view schematically illustrating the storage tree, according to an exemplary embodiment of the present general inventive concept.

FIG. 3A is a top view schematically illustrating the storage tree 100, according to an exemplary embodiment of the present general inventive concept.

FIG. 3B is a bottom view schematically illustrating the storage tree 100, according to an exemplary embodiment of the present general inventive concept.

Referring to FIGS. 1, 2A, 2B, 3A, and 3B, the base 110 may include a stationary portion 111, a rotatable portion 112, a rotation brake 113, and a plurality of wheels 114. The rotatable portion 112 may rotate with respect to the stationary portion 111, to allow the user to rotate the storage tree 100 without moving the storage tree 100 in a lateral direction. In other words, the storage tree 100 is designed to be rotatable even without wheels.

The rotatable portion 112 of the base 110 may include two parts, namely a base top 112*a* and a turntable 112*b*, while the stationary portion 111 of the base 110 may be a base bottom 111. A top surface of the turntable 112*b* may be connected to a bottom surface of the base top 112*a*, while a bottom surface of the turntable 112*b* may be connected to a top surface of the base bottom 111. In other words, the turntable 112*b* may be disposed between the base top 112*a* and the base bottom 111. As a result, the base bottom 111 may remain stationary while the base top 112*a* rotates. The base 110 may have a circular shape, an octagonal shape, or a square shape, but is not limited thereto.

Optionally, as illustrated in FIGS. 2A and 2B, a motor 115 including circuitry and/or a computer to receive commands may be installed within the base 110 to allow the base to turn automatically via remote control, button, voice command, or mobile device, such as a cell phone, but is not limited thereto.

The base 110 may also include a molding 116 (or other mechanism to act as a wall) disposed around an outer circumference of the base 110, thereby preventing objects disposed on the base 110 from falling off the base 110 as the storage tree 100 spins.

The rotation brake 113 may prevent the rotatable portion 112 from rotating with respect to the stationary portion 111. The rotation brake 113 may include a pin 113*a* insertable into a hole 113*b* in the base 110, to prevent the rotatable portion 112 from rotating. More specifically, the base top 112*a* and the base bottom 111 may have a series of holes 113*b* to allow a pin 113*a* to be inserted therethrough when the holes 113*b* are in line with respect to each other.

Figure 4:
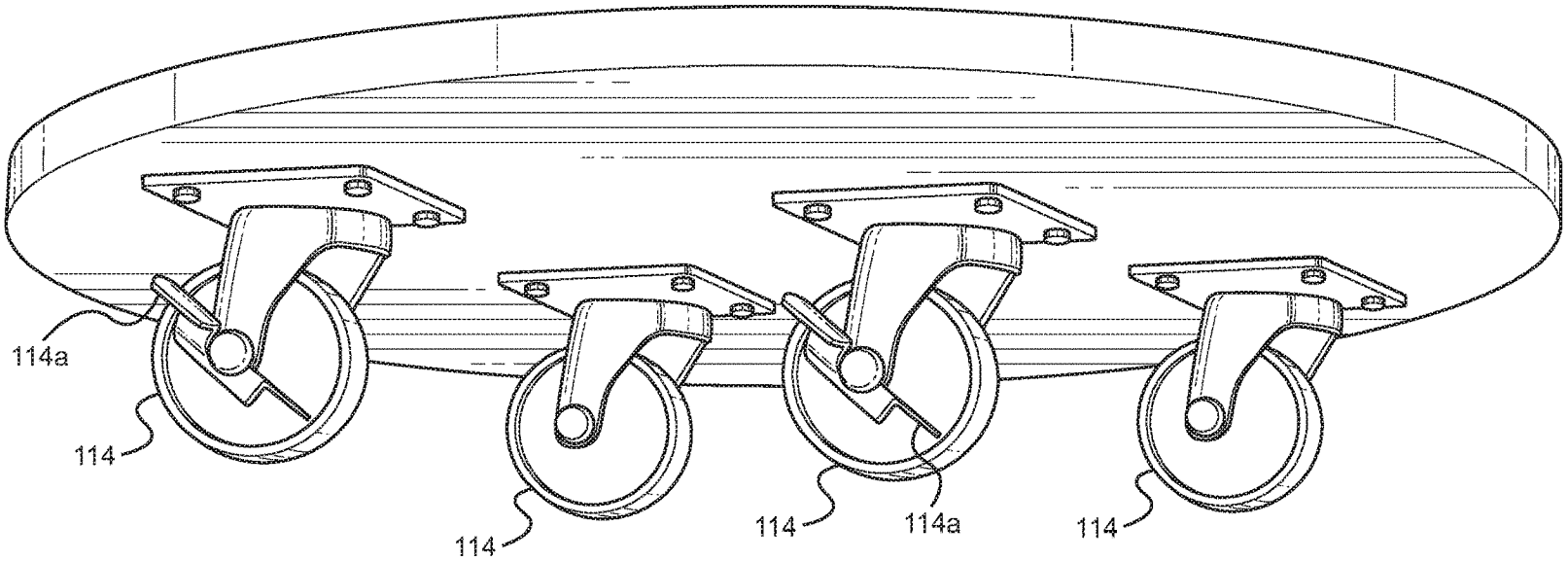
FIG. 4 is a close-up view of a plurality of wheels, according to an exemplary embodiment of the present general inventive concept.

FIG. 4 is a close-up view of a plurality of wheels 114, according to an exemplary embodiment of the present general inventive concept.

Referring to FIG. 4, at least one of the plurality of wheels 114 may include a brake 114*a* to prevent the storage tree 110 from moving in lateral directions. The brake 114*a* may lock the wheel 114, in order to prevent the wheel 114 from rotating. The plurality of wheels may be provided in sets of 3, 4, 5, or more wheels, based on a user's preference.

Referring to FIGS. 1, 2A, and 2B, the center post 120 and the plurality of outer posts 130 may each have a rectangular shape, a square shape, an octagonal shape, or a circular shape, but are not limited thereto.

Optional hooks may be attached to the center post 120 and/or the plurality of outer posts 130 for additional storage capabilities.

For ease of explanation, an embodiment of the present general inventive concept will be described to include one center post 120 having a shape of a rectangular prism, four outer posts 130 each having a shape of rectangular prisms, and a circular base 110 to which one end of each of the four outer posts 130 and the center post 120 are attached. The four outer posts 130 and the center post 120 may be attached to the base 110 using screws, bolts, glue, or any other type of attachment and securing mechanism known to one of ordinary skill in the art. Although the present embodiment of the present general inventive concept includes four outer posts 130, the present general inventive concept is not limited thereto, and may include 2, 3, or more outer posts 130.

The four outer posts 130 may be equidistant from each other, and may be disposed and attached at outer circumferential portions of the base 110. The center post 120 may have panel receiving grooves 121 on each of its lateral faces. Each of the four outer posts 130 may also have a panel receiving groove 131 on lateral faces thereof that face the center post 120. As a result, a panel 140 can be slid between one of the outer posts 130 and the center post 120, and thus secured therebetween. A lateral post 150 may extend horizontally across a top surface of the panels 140 in order to prevent the panels 140 from being removed, and to stabilize the out posts 130 and the center post 120 with respect to the base 110. There may be a plurality of lateral posts 150 to secure the outer posts 130 to the center post 120. The lateral post 150 may also be removable.

Alternatively, a removable round upper cover (not illustrated) may be included to secure the outer posts 130 to the center post 120 for stability, such that the round upper cover slides into top portions of each of the outer posts 130 and center post 120.

As illustrated in FIG. 2A and 2B, the panels 140 may include panels made from wood, metal, plastic, fabric, or any other material able to support objects disposed thereupon. As illustrated in FIG. 2A, the panels 140 may include a peg board (i.e., a board with holed allowing pegs or hooks to be inserted in the holes, a cork board, a bulletin board, installed pegs, a thread rack, shelving, a chalk board, a dry-erase board, grommets, hooks, hangers, VELCRO, pockets, or any other type of mechanism to store objects thereupon or therein. Also, the aforementioned objects included in or on the panel 140 may be installed using magnets. More specifically, for example, a dry-erase board may be attached to the panel using a magnet when the panel is made of magnetic material, or alternatively, the panel 140 may be painted with magnetic paint.

The panels 140 allow a user to hang items thereupon or store items therein, including, but not limited to, tools, utensils, containers, thread, projects, crafts, and paper.

As illustrated in FIGS. 2A and 2B, the panel receiving grooves 121 and 131 may be formed to also receive additional removable panels 140, to allow a user to use a peg board 140*a* on one side and a chalk board 140*b* and a paint rack 140*c* on another side, for example.

Alternatively, the center post 120 may have lateral bar receiving holes 122 on each of its lateral faces, preferably near top and bottom portions of the center post 120. Each of the outer posts 130 may also have lateral bar receiving holes 132 on lateral faces thereof that face the center post 120 and correspond to the lateral bar receiving holes 122 of the center post. As a result, an upper lateral bar 160*a* can be inserted into an upper lateral bar receiving hole 122*a* of the center post 120 and a lateral bar receiving hole 132*a* of one of the plurality of outer posts 130, for example, and thus secured therebetween.

Optionally, a lower lateral bar 160*b* can be inserted in a lower lateral bar receiving hole 122*b* of the center post 120 and a lower lateral bar receiving hole 132*b* of one of the plurality of outer posts 130, for example, and thus secured therebetween.

Although FIGS. 1 through 2B illustrate two panels that are peg boards inserted into panel receiving grooves and two panels including the lateral bars, fabric, and lateral bar receiving holes, any combination of panels may be included in the present general inventive concept, thereby allowing for any combination and/or number of of peg boards, panel receiving grooves, lateral bars, fabric, and lateral bar receiving holes. In other words, every post may include panel receiving grooves and lateral bar receiving holes to allow a user to configure and modify the storage tree 100 as desired.

Figure 5A:
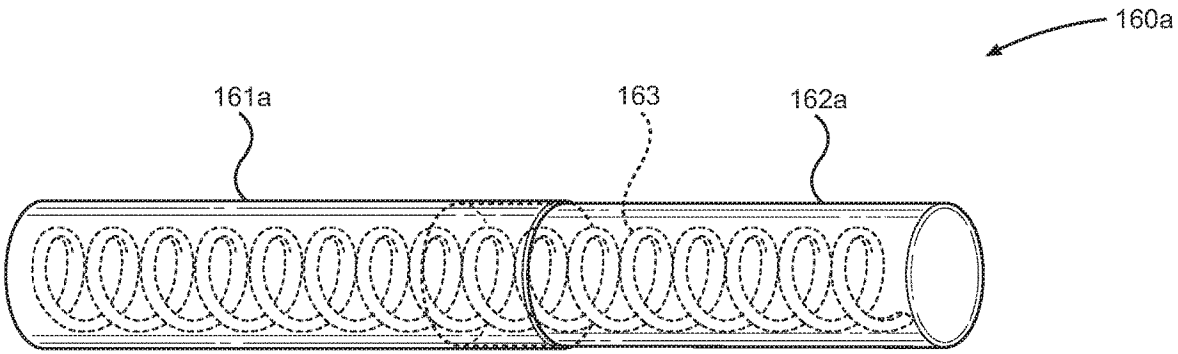
FIG. 5A is a close-up view of the lateral bar in an expanded state, according to an exemplary embodiment of the present general inventive concept.

FIG. 5A is a close-up view of the lateral bar 160*a* in an expanded state, according to an exemplary embodiment of the present general inventive concept.

Figure 5B:
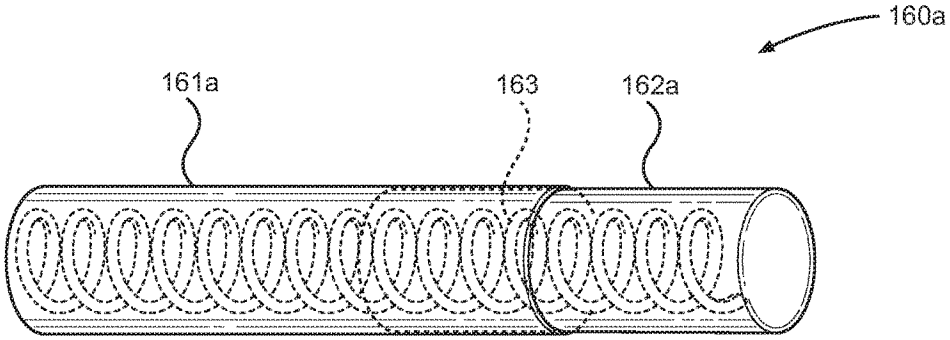
FIG. 5B is a close-up view of the lateral bar in a contracted state, according to an exemplary embodiment of the present general inventive concept.

FIG. 5B is a close-up view of the lateral bar 160*a* in a contracted state, according to an exemplary embodiment of the present general inventive concept.

Referring to FIGS. 1, 2A, 2B, 5A, and 5B, the upper and lower lateral bars 160*a* and 160*b*, respectively, may include two separate enjoined pieces that are independently movable with respect to each other via a mechanism, such as a spring disposed therewithin, to allow the upper and lower lateral bars 160*a* and 160*b*, respectively, to contract slightly in order to be insertable within the upper and lower lateral bar receiving holes 122*a*, 132*a*, 122*b*, and 132*b*, respectively.

Referring specifically to FIG. 5A, the lateral bar 160*a* may include a first half 161*a* and a second half 162*a* having a portion disposed within the first half 161*a*. The first half 161*a* may be connected to the second half 162*a* by a spring 163. In FIG. 5A, the spring is in an expanded and relaxed state.

In FIG. 5B, a user may press the first half 161*a* towards the second half 162*a*, such that the spring 163 is contracted, thus allowing ends of the lateral bar 160*a* to be inserted within the lateral bar receiving holes 122*a* and 132*a*, respectively.

The upper and lower lateral bars 160*a* and 160*b*, respectively, allow for installation of fabric panels 140 as an alternative to solid panels. For example, a fabric panel 140 may be draped over an upper lateral bar 160*a* and wrapped around a lower lateral bar 160*b*, such that the fabric may be connected (joined together) at a lower portion thereof. The fabric may be connected using snaps, pins, VELCRO, buttons, zippers, thread, or any other type of connection mechanism.

The fabric panels 140 may be removable to allow for easy removal for washing and cleaning.

The fabric panel 140 may also include pockets 141 to store items therein. The pockets may be closable using snaps, pins, VELCRO, buttons, zippers, thread, or any other type of closing mechanism. Also, the pockets 141 may include lid portions 142 to allow the pockets to be closed. The pockets 141 can be constructed out of various materials.

Alternatively, the fabric panel 140 and/or pockets 141 may be made out of a transparent and/or translucent plastic, to allow a user to easily view items stored within the transparent and/or translucent pockets.

The upper lateral bars 160*a* may also be included without the fabric panels 140, in order to allow items, such as clothing, to be hung thereupon. For example, if a user is designing a dress for a woman, the dress can be hung from a hanger hanging on an upper lateral bar 160*a*, in order to allow the user to work on the dress while having easy and convenient access to items stored on other panels, such as thread, needles, buttons, sequins, glitter, rulers, measuring tape, chalk, or whatever other items are necessary to complete the dress.

A cover (not illustrated) can be included to cover the entire storage tree 100, and can be made of plastic, fabric, wood, metal, or any other material usable to cover the storage tree 100.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A storage tree, comprising:

a rotatable base;

a center post attached to a center portion of the rotatable base;

a plurality of outer posts attached to and in direct contact with the rotatable base at outer edges of the rotatable base, and a plurality of panels disposed between each of the plurality of outer posts and the center post, wherein at least one of the plurality of panels is a peg board comprising holes, and at least another one of the plurality of panels is a fabric panel comprising at least one pocket on a surface thereof an upper lateral bar disposed between the center post and one of the plurality of outer posts such that the center post is connected to the one of the plurality of outer posts at upper portions thereof;

a lower lateral bar disposed between the center post and the one of the plurality of outer posts such that the center post is connected to the one of the plurality of outer posts at lower portions thereof; and a fabric panel draped over the upper lateral bar and wrapped around a lower lateral bar, such that the fabric is connected at a lower portion of the fabric panel.

2. The storage tree of claim 1, wherein the fabric panel is detachably connected at the lower portion of the fabric panel.

3. The storage tree of claim 1, wherein the center post comprises at least one panel receiving groove and at least one of the plurality of outer posts comprises at least one panel receiving groove facing the at least one panel receiving groove of the center post.

4. The storage tree of claim 3, wherein at least one of the plurality of panels is disposed within the at least one panel receiving groove of the center post and at least one panel receiving groove of the at least one of the plurality of outer posts.

5. The storage tree of claim 1, wherein the rotatable base comprises;

a plurality of wheels to allow the storage tree to move laterally;

a base bottom attached to the plurality of wheels;

a turntable rotatably connected to the base bottom; and a base top fixed to the turntable to allow the storage tree to rotate without movement from the plurality of wheels.

* * * * *